United States Patent [19]

Baccialon

[11] 4,205,664

[45] Jun. 3, 1980

[54] TOOTH AND GUM MASSAGING IMPLEMENT

[76] Inventor: Maria O. Baccialon, 401 E. 89th St., New York, N.Y. 10028

[21] Appl. No.: 771,755

[22] Filed: Feb. 24, 1977

[51] Int. Cl.[2] ..... A61H 7/00

[52] U.S. Cl. ..... 128/62 A

[58] Field of Search ..... 128/62 A, 304; 32/40, 32/58; 132/92 A, 92 R; 15/236 R

[56] References Cited

U.S. PATENT DOCUMENTS

| | | | |
|---|---|---|---|
| 726,727 | 4/1903 | Mills | 128/62 A |
| 2,016,597 | 10/1935 | Drake | 32/58 |
| 2,677,843 | 5/1954 | Goodman | 32/40 R |
| 2,925,087 | 2/1960 | Kucher | 132/92 |
| 3,368,553 | 2/1968 | Kirby | 132/92 R |
| 3,563,233 | 2/1971 | Bodine | 128/62 A |

FOREIGN PATENT DOCUMENTS

| | | | |
|---|---|---|---|
| 428891 | 9/1911 | France | 132/89 |

*Primary Examiner*—Robert Peshock

*Attorney, Agent, or Firm*—Holland, Armstrong, Wilkie & Previto

[57] ABSTRACT

An improved dental implement is disclosed for daily or periodic gum massage. The implement has massaging heads with particular shapes or curvatures for effective gum massage to stimulate and to promote the health of the user's gums. The preferred shapes facilitate effective treatment of both the inner and outer gum surfaces as well as the gum surfaces at the rear of the user's mouth. A number of embodiments are described having detachable or replaceable heads for both massage and cleaning as well as including means for an electrically operated vibratory massage.

5 Claims, 14 Drawing Figures

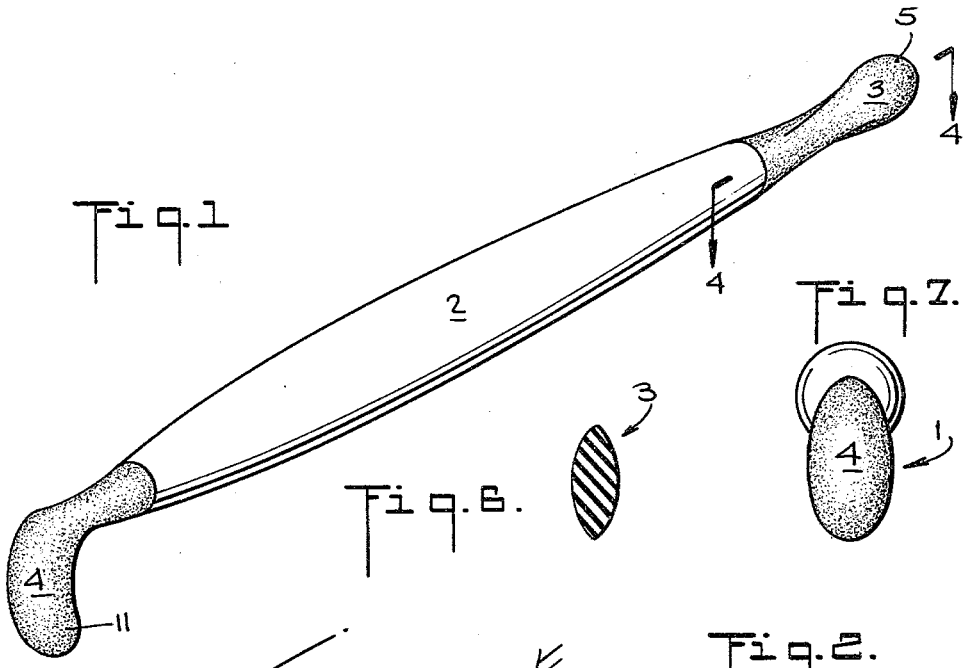
Fig. 1
Fig. 6.
Fig. 7.
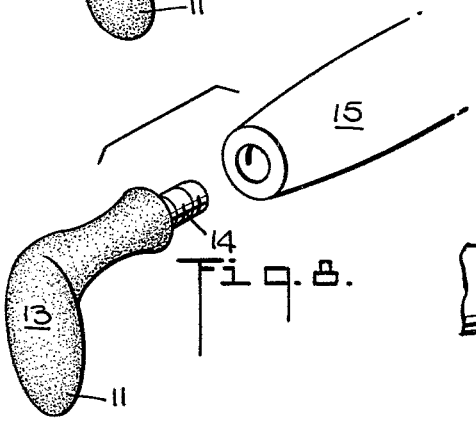
Fig. 8.
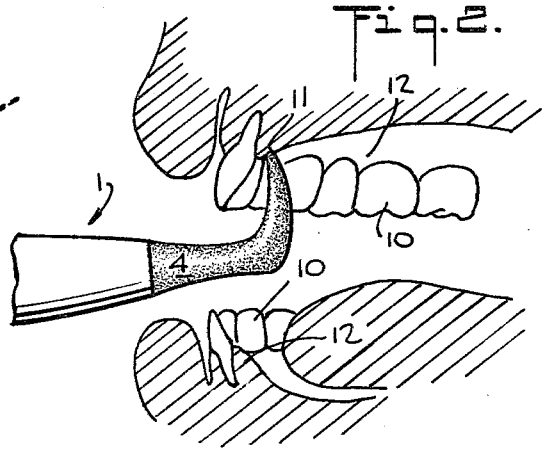
Fig. 2.
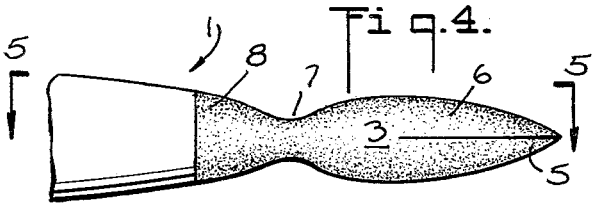
Fig. 4.
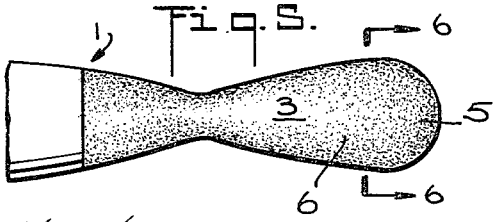
Fig. 5.
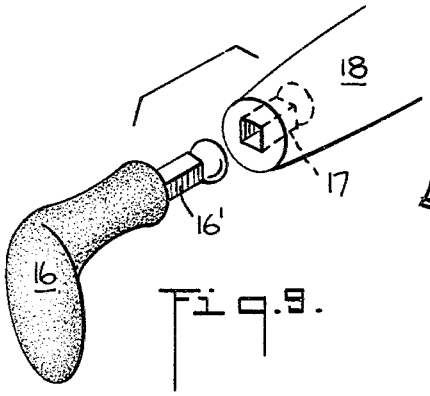
Fig. 9.
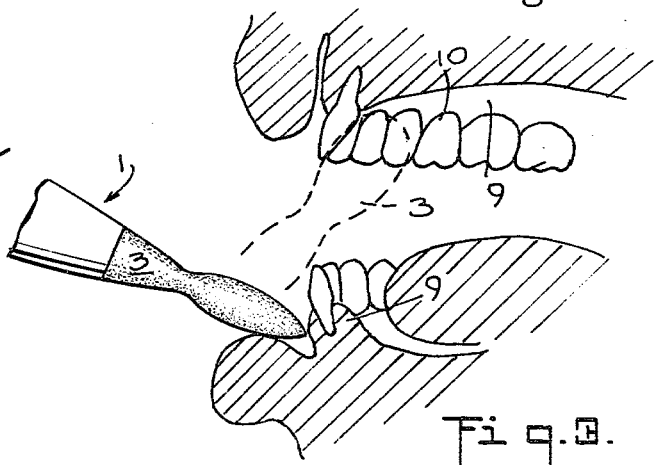
Fig. 3.

TOOTH AND GUM MASSAGING IMPLEMENT

BACKGROUND OF THE INVENTION

The present invention relates to dental implements and more particularly to an improved implement for gum massage which is particularly designed for effective gum massage by individuals on a regular basis to improve the health of their gums.

It is known that the health of a person's gums may be improved by a regular gentle massaging operation performed one or more times a day in addition to the regular teeth cleaning by brushing.

Many cases of dental trouble, particularly in older persons, stem from gum problems and particularly from a tender condition of the gums. Whatever other treatments may be desirable or prescribed for maintaining health gums or for improving the gum condition, it has been found that a regular gentle massaging or stimulation of the gums promotes increased circulation in the gums which is beneficial.

While there are a number of implements presently marketed for use in such a gum massage, these implements normally double as auxiliary cleaning devices. Accordingly, they tend to have a relatively sharp shape to facilitate the cleaning function. This makes their use difficult particularly on the interior surfaces of the gums behind the teeth and in the rear portions of the mouth. Accordingly, the purpose of the present invention is to provide an improved tooth massaging implement which will facilitate and encourage massage by being conveniently and effectively used in the home on a daily basis. Additionally, the improved dental massaging implement of this invention is shaped not only for permitting the outer and forward gum surfaces to be easily and effectively massaged, but it is also shaped for providing a gentle and effective and simply performed massage of inner gum surfaces and the gum surfaces in the rear portions of the user's mouth.

Accordingly, an object of the present invention is to provide an improved gum massaging implement.

Another object of the present invention is to provide a more effective and more easily manipulated gum massaging implement.

Another object of the present invention is to provide a gum massaging implement with increased effectiveness on rear and inner gum surfaces.

Another object of the present invention is to provide a gum massaging implement with related brush cleaning means.

Another object of the present invention is to provide a gum massaging implement adapted for the application of powder or paste material during the massaging action.

Another object of the present invention is to provide an improved gum massaging implement having an electrically actuated vibratory or oscillating movement for facilitating the gum massage.

Another object of the present invention is to provide a gum massaging implement adapted for use with a variety of operating heads for differing massaging or cleaning operations.

Other and further objects of the invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 1 is a perspective view illustrating a preferred embodiment of a tooth massaging implement in accordance with the present invention.

FIGS. 2 and 3 are sectional views of a user's mouth illustrating a massaging operation with the implement of FIG. 1 on inner and outer surfaces, respectively.

FIG. 4 is an enlarged view partially in section, of the outer gum massaging fitting taken along line 4—4 on FIG. 1.

FIG. 5 is an enlarged detailed view of the outside massaging head partially in section taken along line 5—5 on FIG. 4.

FIG. 6 is a sectional view of the head of FIG. 5 taken along line 6—6 on FIG. 5.

FIG. 7 is an end view of the inner massaging head of FIG. 1.

FIG. 8 is a detailed perspective view illustrating a means for releasably attaching a massaging head to the handle.

FIG. 9 is a detailed perspective view illustrating another embodiment of a massaging head attachment means.

DESCRIPTION OF THE PREFERRED EMBODIMENT

Figure 10:
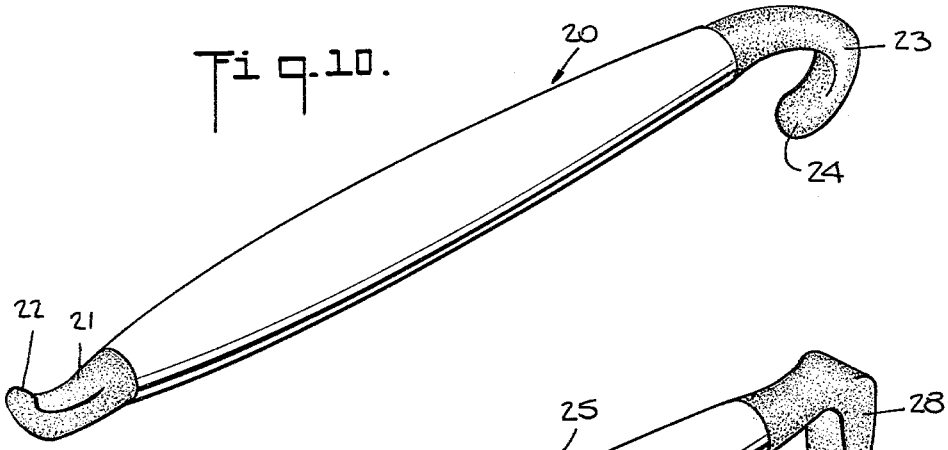
FIGS. 10 and 11 are perspective views of alternate embodiments of tooth massaging implements.

The improved gum massaging implement will first be described generally with particular reference to FIGS. 1 through 7.

A preferred embodiment of the massaging implement 1 comprises an elongated handle 2, preferably of rounded cross-section for convenient gripping, having a massaging head mounted on one or both ends. A preferred embodiment has an outer gum massaging head 3 mounted on one end of the handle 2 and an inner gum massaging head 4 mounted on the other end.

The outer head 3 has rounded gum massaging surfaces of the general shape best illustrated in detailed FIGS. 4–6.

The outer gum massaging head 3 has a generally eliptical or oval cross-section from one end to the other, such as illustrated in FIG. 6. When viewed from the side, as illustrated in FIG. 4, the head tapers from a rounded massaging edge or surface 5 outwardly to a thickened and rounded central portion 6. Thereafter, its opposite surfaces curve inwardly towards one another to a necked-in portion 7 and then finally to a flared mounting portion 8.

When viewed from the top, as illustrated in FIG. 5, the head 3 has a generally semi-circular shape for the massaging surface 5. The rounded edges of the head then taper inwardly in the necked-in portion 7 and to the mounting portion 8.

This shaping provides convenient massaging surfaces for the implement including the surface 5 which is relatively narrow in one dimension for providing access to restricted gum areas intermediate the teeth. The implement is rotated in use by the user, as necessary, so that the surfaces 5 and 6 may be employed to massage the various gum 9 surfaces starting at the front of the mouth and working to its rear.

As illustrated in FIG. 3, the smooth and rounded surface 5 may be gently pressed and rocked or stroked against the outer gum surfaces 9 surrounding the teeth 10. The gum is massaged by the gentle rocking or rolling or massaging movement of the rounded surfaces 5 and 6 against the gum 9. The user selects the appropriate portions of the head 3 to use in accordance with the particular portion of the gum being massaged. Forward outer gum surfaces, for example, will be massaged using the surface 5 of the head 3 as this portion of the head 3 is conveniently moved directly into contact with all gum surfaces surrounding the forward or frontal teeth 10. The head 3 is shown in FIG. 3 with the edge 5 positioned generally horizontally in the lower illustrations and with the edge 5 positioned generally vertically in the upper illustrations.

Gum surfaces for the rear teeth are more conveniently massaged using the curved portions 6 of the head 3 more distant from the edge 5.

The massaging head 3, as well as the other heads described, are resilient material, such as natural rubber, which has been found to provide a particularly effective massaging action on the gums. Rubber-like plastic formulations may also be employed. While the heads 3 and 4 may be permanently attached to the handle 2, they also may conveniently be detachably mounted for replacement by a screw thread or snap-on prong of the type illustrated in FIGS. 4–6 or by other connecting means.

A head 4 of differing shape is preferably provided for facilitating the massaging of the inner gum surfaces as illustrated in FIGS. 1, 2 and 7. The head 4 has a hook-shaped or curved form with a rounded gum massaging surface 11 at its outer end. The surface 11 is provided on the curved or generally hook-shaped massaging head for facilitating the placement of the massage surface 11 against the inner gum surfaces 12. The head 4 is illustrated, for example, in FIG. 2 massaging the gum surfaces 12 behind the user's front teeth 10. It is similarly employed upon all inner gum surfaces with the outer portions of the surface 11 being employed for the teeth 10 near the front of the mouth and with the lateral or side portions of the surface 11 being used for the gum 9 adjacent to the teeth 10 in the back part of the user's mouth. The hooked portion in cross-section is rounded in a manner similar to that of the head 3 as shown for head 3 in FIG. 6.

The massaging heads may be permanently fixed to the handle or they may be detachably connected for replacement. This may be done to renew the heads or to provide for differing heads on one handle. FIGS. 8 and 9 illustrate a threadedly connected and snap-on detachable mountings for massaging heads. Thus, the head 13 is attached by the threaded stud 14 to the handle 15 and a head 16 has a snap attachment 16' for releasably engaging a socket 17 in a handle 18.

A number of variations in the shaping of the massaging heads may be utilized for providing the various massage operations described generally above. FIG. 10, for example, illustrates an implement 20 with a head 21 for outer portions of the gum having a shallow curve or hook which still permits direct massage of the forward gum surfaces and which facilitates the massaging of the more rearward portions of the gum due to the slight curvature of the portion 22 of the head 21. FIG. 7 also illustrates a massaging head 23 for inner gum surfaces having a more rounded or hooked shape than the head 4. The head 23 has a generally semi-circular form permitting the implement 20 to be held more horizontally in the mouth while at the same time presenting the massaging surface 24 to the inner gum surfaces.

Figure 11:
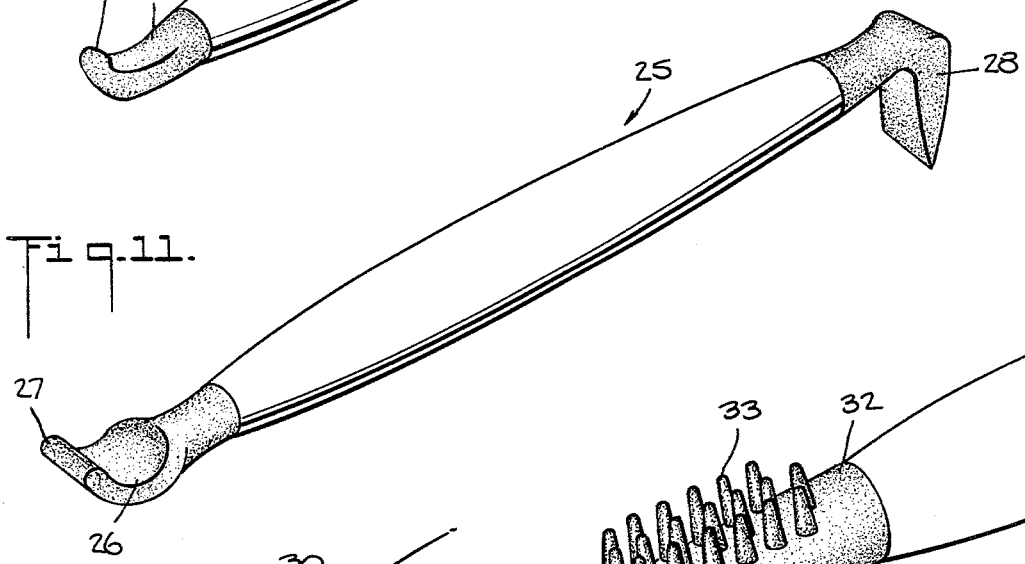

FIG. 11 illustrates two additional forms of the massaging heads on an implement 25 including an outer massaging head 26 with a rounded massaging surface 27 having a straighter edge than the surface 5 of head 3. This provides an increased contact area which may be desirable for certain gum shapes. An inner massaging head 28 shown on the implement 25 of FIG. 8 similarly has a generally straight edge 29 with a rounded cross-section provided on the outer end of a generally L-shaped massaging head 28.

Figure 12:
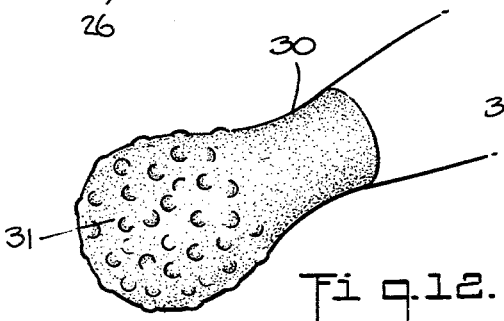
FIG. 12 is a detailed perspective view illustrating an embodiment of a tooth massaging implement having paste or powder retaining means on its surfaces.

FIG. 12 illustrates a modified form of a rounded massaging head 30 having a slightly roughened surface 31 to facilitate the retention of a salve or ointment which may be used in conjunction with the gum massaging. The roughened surface 31 is provided by recessed portions formed by indentations or optionally by slightly raised areas or knobs.

Figure 13:
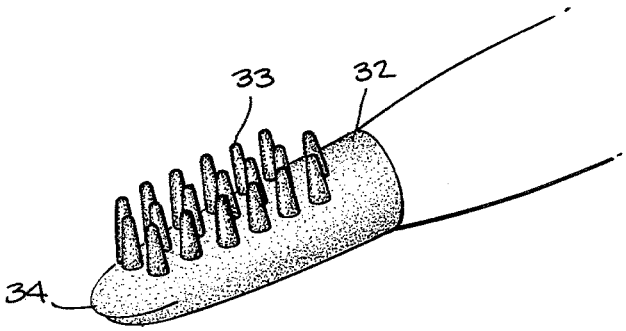
FIG. 13 is a detailed perspective view of another embodiment of a head for the implement for use in cleaning teeth.

FIG. 13 illustrates another head 32 which may be attached to the handles described above and which has a number of protruding or bristle-like teeth cleaning members 33. The head 32 may be used for providing a cleansing operation to remove particles and calculus or tartar from the tooth surfaces. Its rounded end 34 also is used for massaging the gums adjacent to the user's teeth. The head 32 may be formed of natural rubber or a rubber-like plastic resulting in the protruding members 33 being slightly flexible to facilitate their cleansing and massaging action.

Figure 14:
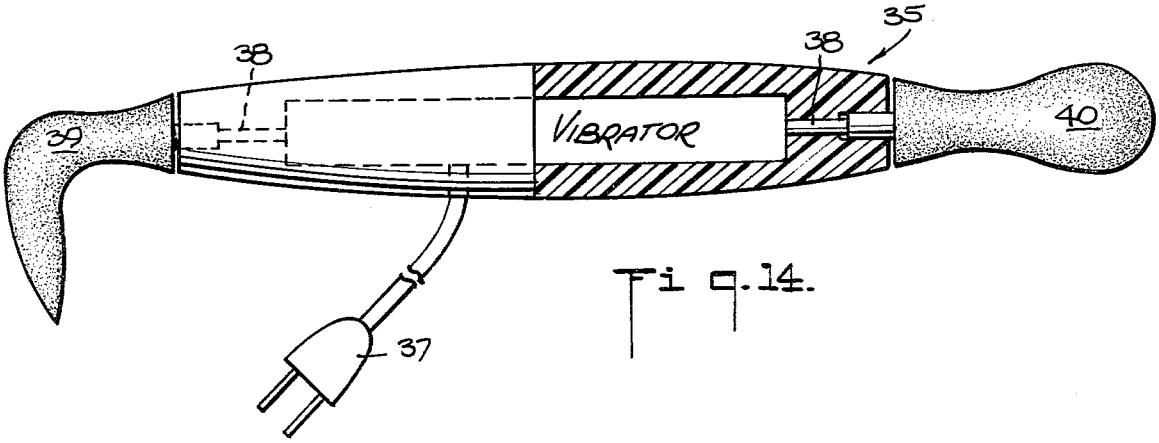
FIG. 14 is a side elevational view, partially in section, illustrating an electrically driven tooth massaging implement.

FIG. 14 illustrates an implement 35 of the general type described above with the addition of an electrically operated vibrator. The vibrator 36 is attached to an external voltage source 37 or may be powered by batteries. The coupling rods 38 physicaly connect the vibrator output to the implement heads 39 and 40 so that a combined vibratory and massaging action results.

It will be seen that an improved tooth massaging implement has been provided. The improved shaping and arrangement of the implement encourages and facilitates periodic gum massage by making the massaging operation more effective and more easily performed.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. In a gum massaging implement having a resilient massaging head mounted on an elongated handle with said massaging head being formed of a resilient material and having a handle connecting portion and an outer massaging end portion extending outwardly from the handle connecting portion the improvement comprising said massaging head having a hooked shape curving towards the handle and having an elongated, sharply rounded, and relatively narrow messaging tip with the cross-section of said hooked end portion inwardly of said tip being generally oval in planes taken through the massaging surface and perpendicular to the plane of the elongated rounded tip for facilitating a massage of the inner gum surface.

2. The improved gum massaging implement claimed in claim 1 in which the massaging head is detachably connected to said handle.

3. The improved gum massaging implement claimed in claim 1 in which said massaging head is formed of rubber.

4. The improved gum massaging implement claimed in claim 1 in which said massaging head is formed of plastic.

5. The improved gum massaging implement claimed in claim 1 which further comprises a second massaging head mounted on said handle with a rounded massaging surface facing in a different direction from those of the massaging surface of said first massaging head.

* * * * *